US008893533B2

(12) United States Patent
Gallucci

(10) Patent No.: US 8,893,533 B2
(45) Date of Patent: Nov. 25, 2014

(54) MACHINE FOR CUTTING LEATHERS

(75) Inventor: Gianni Gallucci, Monte Urano (IT)

(73) Assignee: Teseo S.p.A., Fermo (IT)

( * ) Notice: Subject to any disclaimer, the term of this patent is extended or adjusted under 35 U.S.C. 154(b) by 0 days.

(21) Appl. No.: 14/004,550

(22) PCT Filed: Feb. 24, 2012

(86) PCT No.: PCT/IB2012/050863

§ 371 (c)(1),
(2), (4) Date: Sep. 11, 2013

(87) PCT Pub. No.: WO2012/123837

PCT Pub. Date: Sep. 20, 2012

(65) Prior Publication Data

US 2014/0000321 A1 Jan. 2, 2014

(30) Foreign Application Priority Data

Mar. 16, 2011 (IT) ..... BO2011A0128

(51) Int. Cl.

| | |
|---|---|
| ***C14B 17/00*** | (2006.01) |
| ***B26D 7/01*** | (2006.01) |
| ***C14B 5/00*** | (2006.01) |
| ***C14B 17/04*** | (2006.01) |

(52) U.S. Cl.

CPC ..... *C14B 17/00* (2013.01); *B26D 7/018* (2013.01); *C14B 5/00* (2013.01); *C14B 17/04* (2013.01)

USPC ..... 69/2; 69/21

(58) Field of Classification Search

CPC ..... B26D 1/40; B26D 1/42; B26D 7/01; B26D 7/015; B26D 7/018

USPC ..... 69/1, 2, 21

See application file for complete search history.

(56) References Cited

U.S. PATENT DOCUMENTS

| | | | | |
|---|---|---|---|---|
| 2,090,949 | A * | 8/1937 | Richards | 408/71 |
| 4,296,514 | A | 10/1981 | Dokoupil et al. | |
| 5,089,971 | A * | 2/1992 | Gerber | 700/134 |
| 2002/0002416 | A1 * | 1/2002 | Herman, Jr. | 700/135 |
| 2006/0053991 | A1 * | 3/2006 | Arikita | 83/168 |
| 2008/0028904 | A1 * | 2/2008 | Arikita | 83/24 |
| 2009/0000442 | A1 * | 1/2009 | Peterson et al. | 83/56 |
| 2011/0314985 | A1 * | 12/2011 | Pei | 83/417 |

FOREIGN PATENT DOCUMENTS

| | | |
|---|---|---|
| GB | 2069913 | 9/1981 |
| WO | WO 2006/090252 A1 | 8/2006 |
| WO | WO 2006/094244 A2 | 9/2006 |

* cited by examiner

*Primary Examiner* — Shaun R Hurley

(74) *Attorney, Agent, or Firm* — R. Neil Sudol; Henry D. Coleman

(57) ABSTRACT

A machine for cutting leathers has a bearing structure and an operating element exhibiting a rotation axis and three distinct work planes each arranged about the rotation axis and provided with an aspirating plate that is activatable/deactivatable such as to retain or release the leathers. The operating element successively positions each work plane at three successive and distinct positions with respect to the bearing structure: a first position in which the leathers can be positioned and stretched above the work plane and held stretched thereon, a second position in which the work plane with the leathers stretched and retained thereon is located below a cutter, and a third position wherein the leathers can be unloaded from the work plane by force of gravity following deactivation of the respective aspirating plate.

9 Claims, 2 Drawing Sheets

MACHINE FOR CUTTING LEATHERS

FIELD OF THE INVENTION

The invention relates to the technical sector of working leathers or the like; in particular, the present invention relates to a machine for cutting leathers.

DESCRIPTION OF THE PRIOR ART

In the above-mentioned technical sector, a well-known requirement is to maintain the leathers perfectly stretched during the cutting operation, in order to prevent possible creases or wrinkles from altering the desired final shapes of the leather to be obtained.

For this purpose, machines are known for cutting leathers which comprise a structure supporting a fixed aspirating plane arranged horizontally where the leathers can be stretched, kept stretched and still and then subjected to the cutting operations.

The aspirating plate affords through-holes that are connected to an aspiration source arranged for example below the plane.

The machine further comprises cutting means of an automatic type, borne by the structure, arranged above the operating area and mobile with respect thereto.

A protection cladding usually clads the aspirating plane, constituted by a permeable material, for example felt, on which the leathers to be cut are stretched.

The felt cladding, being permeable, is such that the leathers stretched thereon are attracted by the depression source and held still and stable during the cutting operations; further, thanks to the relative thickness, the cutting means are prevented from reaching the aspirating plane and damaging it.

The leather-stretching operation on the felt is performed by a highly-specialised operator, as specific skills are necessary in order to be able to correctly position the leather on the aspirating plane (felt), with the aim of preventing any folds or wrinkles which might give rise to incorrectly-cut shapes (and therefore to working waste).

The cutting unit is activated once the operator has concluded the leather-stretching operation, while keeping the aspirating source active, with the aim of obtaining a plurality of different shapes, according to needs or the settings entered in the electronic control unit of the cutting means.

Once the leather cutting operations have been completed, the cutting means are halted and distanced from the aspirating plane, the aspirating source is deactivated and the operator has to proceed with the removal of the various cut pieces from the work plane, grouping them on the basis of the different profile of the shapes.

Finally the waste cuttings are removed from the work plane by the operator; once all these operations have been completed the operator can then newly proceed to stretching new leathers on the felt of the work plane.

It is clear that these operations, strictly manual, considerably limit productivity and are poorly compatible with the automatic operations with which the cutting of the leathers is carried out. This constitutes, without a doubt, a drawback that is still not obviated in the known-type machines.

In fact the time necessary and required of the operator in order to collect up and sort all the various cut shapes, and then to free up the aspirating plane too from all the residual working wastes, is much longer than the times required by the operator for the leather stretching operations and for carrying out the cutting operations.

The collecting time of the cut pieces and for the removal of the working waste therefore constitutes a very long non-operative waiting time for the machine, a circumstance which considerably limits overall productivity.

A further drawback of the prior-art machines relates to the fact that the collecting and sorting operation of the cut shapes, as well as the sorting of the working waste, while not requiring special competences, are carried out by the same specialised operator who is occupied with the placing of the leather.

This without date involves high labour costs which however are not truly indispensable for the ends of the above-described operations.

SUMMARY OF THE INVENTION

The aim of the present invention is to obviate the above-cited drawbacks.

In particular, the aim of the present invention is to provide a machine for cutting leathers which is able to perform the operations of removal of the cut leather shapes automatically, rapidly and efficiently, and thus enable, at the same time in which the unloading operations are carried out, proceeding with the positioning, stretching and cutting of other leathers.

The above-cited aim 1s attained by a machine for cutting leathers comprising a bearing structure, and an operating element shaped in such a way as to exhibit a rotation axis and at least three distinct work planes, each of which is arranged about the rotation axis and is provided with an aspirating plate that is activatable/deactivatable such as to retain or release the leathers. Cutting means is associated with the bearing structure, at a side thereof, and movable with respect thereto. The operating element is mountable on the bearing structure rotatable about its rotation axis and is activatable in rotation about the axis in order to successively position each work plane at three successive and distinct positions with respect to the bearing structure, namely, (i) a first position of placing the leathers in which the leathers can be positioned and stretched above the work plane and held stretched thereon following activation of the respective aspirating plate, (ii) a second position of cutting the leathers, in which the work plane with the leathers stretched and retained thereon by the respective aspirating plate is situated below the cutting means such as to enable activation of the cutting means and performing of the shape-cutting operations on the leathers, and (iii) a third position of unloading the leathers, wherein the leathers can be unloaded from the work plane by force of gravity following the deactivation of the aspirating plate.

Further advantageous aspects of the present invention will emerge from the various dependent claims.

BRIEF DESCRIPTION OF THE DRAWINGS

The characteristics of the leather-cutting machine of the present invention are set out in the following description, carried out with reference to the accompanying figures of the drawings, in which.

DESCRIPTION OF PREFERRED EMBODIMENTS

With reference to the accompanying figures of the drawings, reference letter M denotes the machine for cutting leathers which is the object of the present invention in its entirety.

The machine (M) for cutting leathers comprises a bearing structure and an operating element 2 which has the peculiarity of being conformed in such a way to exhibit a rotation axis Z and at least three distinct work planes 21, 22, 23, each of the work planes 21, 22, 23 being arranged about the rotation axis Z and having an activatable-deactivatable aspirating plane for retaining or releasing the leathers.

Figure 2:
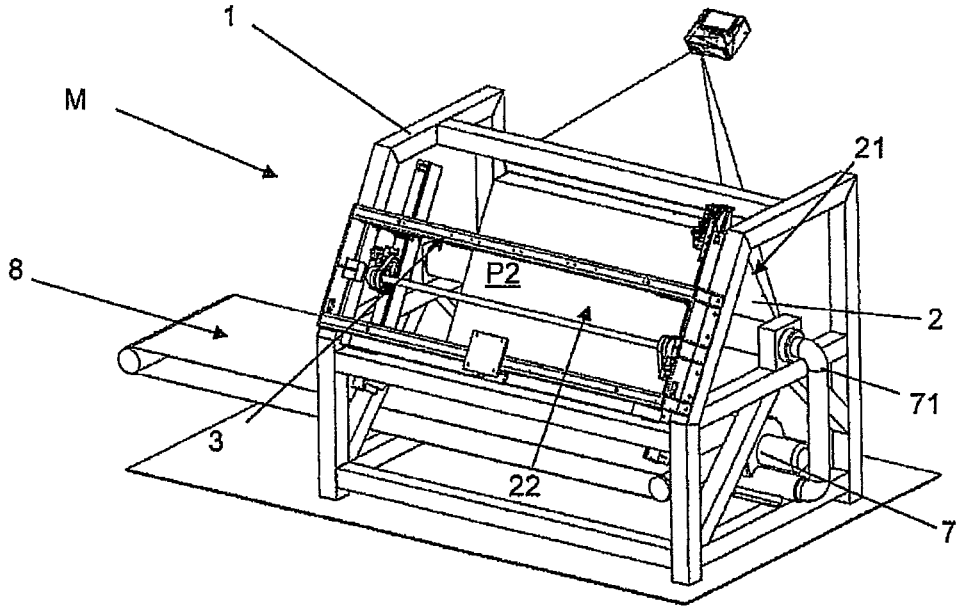
FIG. 2 is the machine of FIG. 1, again in a schematic perspective view, but from a different perspective.
Figure 4:
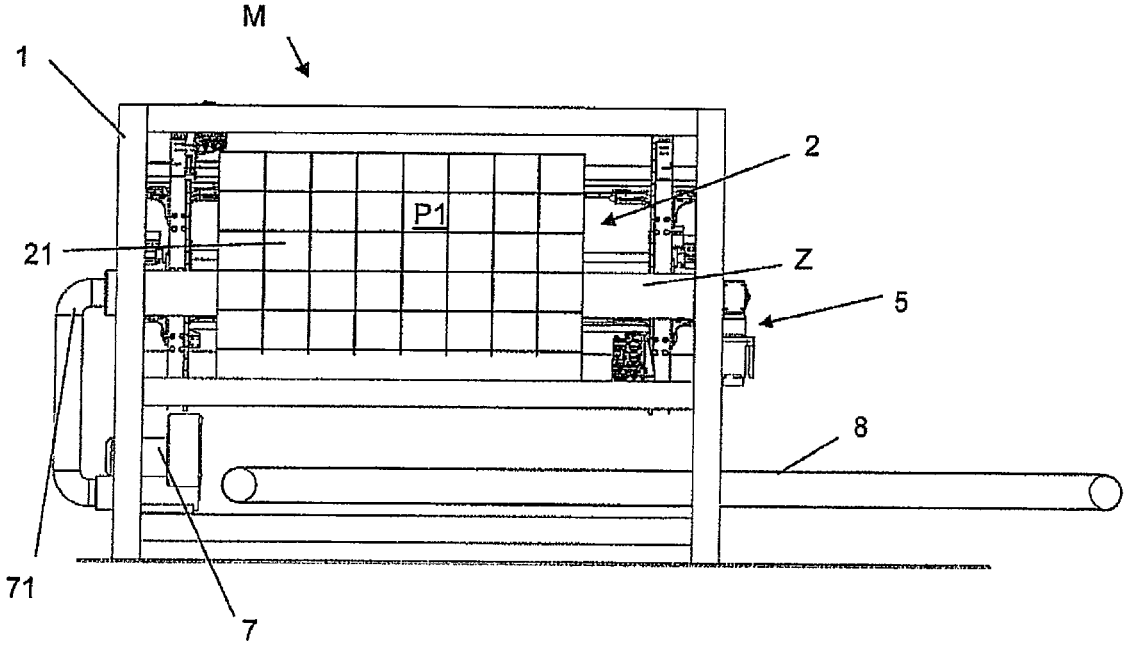
FIG. 4 is a frontal view of the machine of FIG. 1.

The aspirating planes (not illustrated in detail in the accompanying figures as they are of known type) of the work planes 21, 22, 23 communicate via a conduit 71 with an aspirating source 7 (see for example FIG. 2 and FIG. 4) and are activatable independently of one another by means of relative actuator organs (not illustrated).

Figure 1:
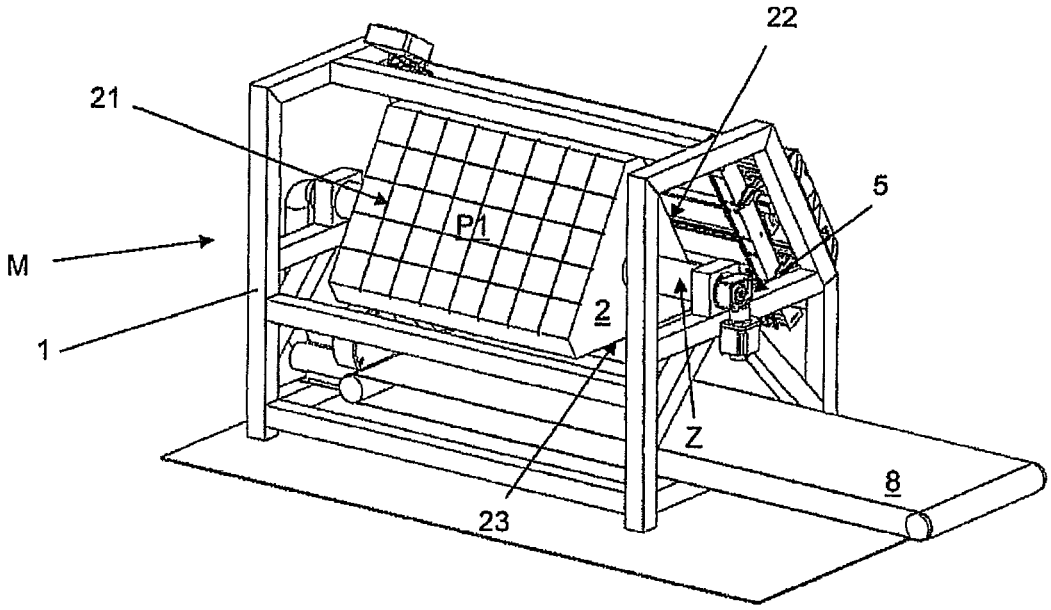
FIG. 1 is a schematic perspective view of the machine for cutting leathers, object of the present invention according to a preferred embodiment.

In a possible embodiment (see for example FIG. 1), one or two or all the work planes 21, 22, 23 of the operating element 2 can be provided with a relative sectorised aspirating plane, where one or more sectors thereof can be activatable in different ways from the remaining other sectors of the plate according to working needs.

The machine of the present invention is also provided with cutting means 3 associated to the bearing structure 1, at a relative side thereof and mobile with respect thereto.

A special characteristic of the machine M of the present invention is constituted by the fact that the operating element 2 is mountable on the bearing structure 1 rotatingly about the axis Z thereof and is activatable in rotation about the axis Z such as to position, in succession, each work plane 21, 22, 23 at three successive and distinct positions P1, P2, P3 with respect to the bearing structure 1.

Figure 3:
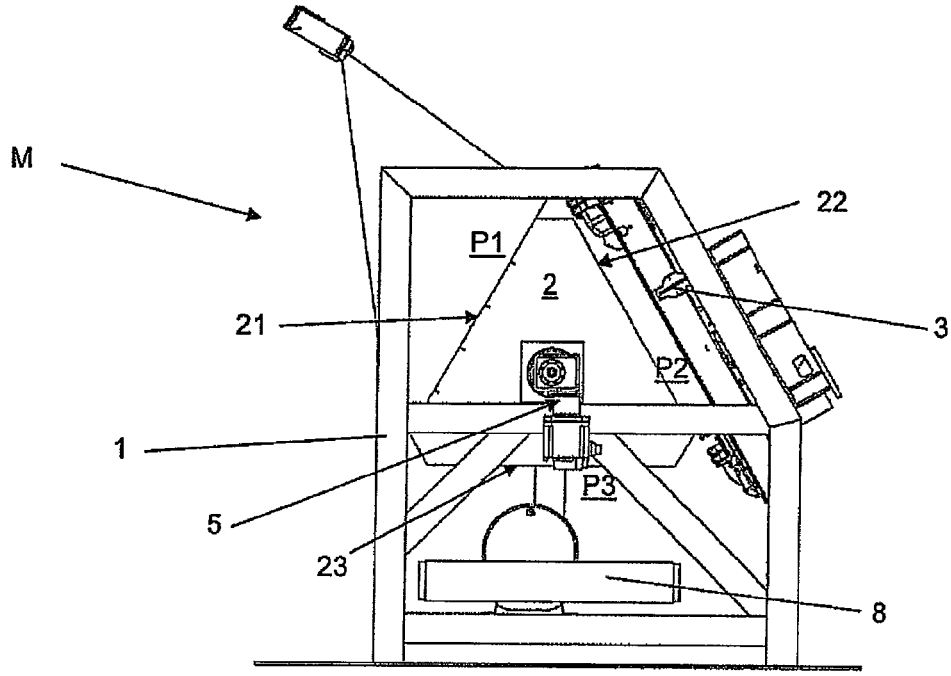
FIG. 3 illustrates a lateral view of the machine of FIG. 1.

In more detail, as is for example clearly visible in FIG. 3, the operating element 2 is activatable in rotation about the axis Z thereof with respect to the bearing structure 1 such as to successively position each work plane 21, 22, 23 with respect to the bearing structure 1 at:

a first position P1 of placing the leathers in which the leathers can be positioned and stretched above the work plane 21, 22, 23 and held stretched thereon following activation of the relative aspirating plate, a second position P2 of cutting the leathers, in which the work plane 21, 22, 23 with the leathers stretched and retained thereon by the relative aspirating plate is situated below the cutting means 3 such as to enable activation of the cutting means 3 and performing of the shape-cutting operations on the leathers, a third position P3 of unloading the leathers, wherein the leathers can be unloaded from the work plane 21, 22, 23 by force of gravity following the deactivation of the aspirating plane.

To activate the operating element in rotation 2, the machine M is equipped with actuator means 5 that are mounted on the bearing structure 1 (see for example FIG. 1 and FIG. 3) and controlled by a control unit provided on the machine M for programming and managing the various cutting operations.

The control unit also manages the cutting means 3 and, on this subject, the cutting means 3 can store the profiles and forms of the shapes that are to be cut in the leathers.

With the machine M of the present invention it is therefore possible, time by time, to activate the operating element 2 in rotation about the rotation axis Z thereof, with respect to the bearing structure 1, in such a way that at a same time (see FIG. 3, for example):

a first work plane 21 is positioned at the first position P1 of the leather positioning;

a second work plane 22 is positioned at the second position P2 in which the leathers are cut;

a third work plane 23 is positioned at the third position P3, in which the leathers are unloaded.

In this way, while an operator can proceed with the positioning and stretching of the leathers on the first work plane 21, which is in the first position P1, the cutting means 3 can perform the cutting operations of the leathers stretched on the second work plane 22, which is in the second position P2, and, at the same time, the already-cut shapes and the working waste present on the third work plane 23, which is in the third position P3, are unloaded by gravity, following the deactivation of the aspirating plate of the third work plane 23, thus freeing up the third work plane 23 for the following stretching of new leathers to be cut.

In practice, starting from the first positioning operation of the leathers the machine M functions in the following way.

At the start of the working the cycle, the situation can be the one illustrated in FIG. 3, where a first work plane 21 is in the first position P1, and the remaining work planes 22, 23 are respectively in the second position P2 and the third position P3.

The operator can proceed to positioning and stretching the leathers on the work plane 21 (the aspirating plate of the plane is activated so as to retain and maintain the leathers perfectly stretched).

Once the positioning is complete, the operating element 2 is activated in rotation by the actuator means 5 about the rotation axis Z thereof such as to bring the first work plane 21 with the leathers into the second position P2 below the cutting means 3, and at the same time a further work plane 23 is positioned in the first position P1.

When this configuration has been reached 2, the operating element 2 is stopped, enabling the operator to proceed with positioning another leather on the work plane 23, which is in the first position P1 (leather-positioning position), and in the meantime the cutting means 3 are activated to perform the cutting operations on the preceding leather stretched on the work plane 21 which is in the second position P2 (leather-cutting position).

When the cutting operations on the leather present on the work plane 21 in the second position P2 below the cutting means 3 have been completed, the operating element 2 is activated in rotation again about the axis Z thereof such as to position the work plane 21 with the leathers cut in the third position P3, and at the same time such as to position the work plane 23 with the new leather to be cut in the second position P2 and the work plane 22, free of leather, in the first position P1.

When this configuration has been reached, the operating element 2 is stopped, the operator can proceed to positioning and stretching a new leather to be cut on the work plane 22 which is in the first position P1 (leather-positioning position), the cutting means 3 are in the meantime activated for the cutting operations on the leather present on the work plane 23 which is in the second position P2 (leather-cutting position) and, at the same time, the aspirating plane of the work plane 21 with the already-cut leathers which is in the third position (P3) (unloading position) is deactivated to enable unloading of the cut shapes and the working waste by action of gravity.

The cyclical repetition of the above-described operations extremely advantageously enables contemporaneously performing, at each stop of the operating element 2, both the positioning of a new leather to be cut and the cutting of a leather and the unloading, entirely automatically, of a leather that has already been subjected to the cutting operations.

In this way the drawbacks of the prior art machines described in the preamble are obviated.

Other advantageous aspects of the machine M of the present invention are the following.

The operating element 2 exhibits a prismatic shape; for example as illustrated in the preferred embodiment of the accompanying figures, it exhibits a triangular prismatic shape with three work planes 21, 22, 23 which are arranged reciprocally to one another with an angle of 60°.

Further, the triangular-prismatic operating element 2, with the three work planes 21, 22, 23 arranged at an angle of 60° to one another, can be mounted, with respect to the bearing structure 1, in such a way that the relative rotation axis Z is arranged horizontal and that when a work plane 21, 22, 23 is situated in the third position P3, i.e. the unloading position of the leathers, it is horizontally positioned and inferiorly of the remaining other work planes 21, 22, 23 (situation illustrated in detail in FIG. 3).

In this way, with the operating element 2 thus-configured, and with such an arrangement with respect to the bearing structure 1, the operator with the task of positioning the leathers works on a work plane, which when positioned in the first position P1, i.e. that of positioning the leathers, is angled by 60°, and can thus carry out the positioning of even large leathers, and further can see the leathers more closely during the steps of the positioning thereof, and can therefore spot any defects, as well as more effectively controlling for the presence of any wrinkles during the stretching thereof.

Further, the operator works in a work zone (first position P1) that is distant and situated, with respect to the structure 1, on the opposite side to the zone where the cutting operations (second position P2); thus the operator can work in total safety.

A further important point is that the machine M of the present invention enables performing unloading of the shapes of the cut leathers and the working waste entirely automatically and immediately, without any need for any operator to intervene.

In this regard, the machine M can exhibit a conveyor organ 8, for example constituted by a conveyor belt, arranged inferiorly of the third position P3 of positioning the work planes of the operating element 2 which receives the cut shapes and the working wastes released by force of gravity from the work plane which is in the third position P3, following the deactivation of the relative aspirating plane.

The cut shapes fall on the conveyor organ 8 that is tilted with respect to the position in which the leathers were located previously stretched on the work plane positioned in the first position P1, exhibiting the face that will constitute the internal side, i.e. not visible, of the final product facing upwards.

This constitutes a further advantage, as during the transport thereof along the belt, the shapes can be subjected to marking operations using ink-jet or laser systems.

In further possible embodiments, and according to the specific operating needs, the machine M can comprise an operating element 2 which exhibits a polygonal prismatic shape having 5 or 6 sides and three work planes that are distinct from one another and connected by connecting sides, or for example a polygonal prismatic shape having 5 or 6 sides and with more than three work planes, for example 5 or 6 work planes, and consequently comprise an activation of the operation element 2 for example in order to have two positions reserved for positioning the leathers, two positions for cutting and one for unloading, or other combinations.

The machine M can further comprise a cladding element made of a permeable material which can be wound about the operating element 2 in such a way as to cover the relative work plane 21, 22, 23 at least at the relative aspirating plates of each of them, with the aim of conserving the integrity thereof and avoid damage thereto by they cutting means.

The above has been described by way of non-limiting example, and any constructional variants are understood to fall within the ambit of the following claims.

The invention claimed is:

1. A machine for cutting leathers, comprising:

a bearing structure, an operating element, shaped in such a way as to exhibit a rotation axis and at least three distinct work planes, each of which is arranged about the rotation axis and is provided with an aspirating plate that is activatable/deactivatable such as to retain or release the leathers, cutting means associated with the bearing structure, at a side thereof, and movable with respect thereto;

the operating element being mountable on the bearing structure rotatably about its rotation axis and being activatable in rotation about the axis in order to successively position each work plane at three successive and distinct positions with respect to the bearing structure:

a first position of placing the leathers in which the leathers can be positioned and stretched above the work plane and held stretched thereon following activation of the respective aspirating plate, a second position of cutting the leathers, in which the work plane with the leathers stretched and retained thereon by the respective aspirating plate is situated below the cutting means such as to enable activation of the cutting means and performing of the shape-cutting operations on the leathers, a third position of unloading the leathers, wherein the leathers can be unloaded from the work plane by force of gravity following the deactivation of the aspirating plate.

2. The machine of claim 1, wherein the operating element exhibits a prismatic shape.

3. The machine of claim 2, wherein the prismatic operating element exhibits a triangular shape with three work planes, each of which is reciprocally arranged at 60° to the others.

4. The machine of claim 2, wherein the prismatic operating element exhibits a polygonal shape with more than three sides and with three or more work planes.

5. The machine of claim 1, further comprising actuator means mounted on the bearing structure for rotating activation of the operating element about the rotation axis.

6. The machine of claim 1, wherein the operating element is activatable in rotation with respect to the rotation axis thereof, with respect to the bearing structure, such that at a same time a first work plane is positioned at the first position of positioning of the leathers, a second work plane is positioned at the second position of cutting the leathers, and a third work plane is positioned at the third position of unloading the leathers.

7. The machine of claim 1, wherein the operating element is mounted, with respect to the bearing structure, in such a way that the respective rotation axis is arranged horizontally and that when a work plane is situated in the third position of unloading the leathers it is positioned horizontally and inferiorly of the remaining work planes.

8. The machine of claim 1, further comprising a conveyor means for receiving the cut leathers from a work plane positioned in the third position of unloading the leathers consequently to deactivation of the aspirating plate of the work plane.

9. The machine of claim 1, further comprising a cladding element made of a permeable material wound about the operating element in such a way as to cover the respective work planes at least at the aspirating plates of each thereof.

* * * * *